US010323505B2

(12) United States Patent
Kyle

(10) Patent No.: US 10,323,505 B2
(45) Date of Patent: Jun. 18, 2019

(54) RADIOACTIVE TAG DETECTION FOR DOWNHOLE POSITIONING

(71) Applicant: HALLIBURTON ENERGY SERVICES, INC., Houston, TX (US)

(72) Inventor: Donald Kyle, Plano, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/778,611

(22) PCT Filed: Jan. 12, 2016

(86) PCT No.: PCT/US2016/013084
§ 371 (c)(1),
(2) Date: May 23, 2018

(87) PCT Pub. No.: WO2017/123209
PCT Pub. Date: Jul. 20, 2017

(65) Prior Publication Data

US 2018/0291725 A1 Oct. 11, 2018

(51) Int. Cl.
*E21B 47/09* (2012.01)
*E21B 47/04* (2012.01)

(52) U.S. Cl.
CPC ..... *E21B 47/044* (2013.01)

(58) Field of Classification Search
CPC ..... E21B 47/044
See application file for complete search history.

(56) References Cited

U.S. PATENT DOCUMENTS

| | | | |
|---|---|---|---|
| 4,622,463 | A | 11/1986 | Hill |
| 5,204,529 | A | 4/1993 | Diatschenko |
| 5,461,909 | A | 10/1995 | Arnold |
| 6,037,585 | A | 3/2000 | Gadeken |
| 6,333,699 | B1 | 12/2001 | Zierolf |
| 6,516,663 | B2 | 2/2003 | Wong |
| 7,000,692 | B2 | 2/2006 | Hosie et al. |
| 7,301,474 | B2 | 11/2007 | Zimmerman |
| 8,016,036 | B2 | 9/2011 | Kirkwood et al. |
| 8,237,585 | B2 | 8/2012 | Zimmerman |

(Continued)

FOREIGN PATENT DOCUMENTS

| | | | |
|---|---|---|---|
| GB | 2392179 | A | 2/2004 |
| GB | 2392179 | B | 7/2005 |

(Continued)

OTHER PUBLICATIONS

International Search Report and Written Opinion; PCT Application No. PCT/US2016/013084; dated Sep. 28, 2016.

*Primary Examiner* — Marcus H Taningco
(74) *Attorney, Agent, or Firm* — Polsinelli PC

(57) ABSTRACT

Disclosed are systems and methods for positioning of downhole tools via radioactive tag detection. The method comprises positioning a radiation detector at a first position within a wellbore, logging radiation data while the radiation detector is moved from the first position to a position adjacent to or past a radioactive marker disposed within the wellbore, determining, based on the radiation data, a time at which the radiation detector is adjacent to the radioactive marker, and calculating, based on the time, a distance between the first position of the radiation detector and the radioactive marker.

20 Claims, 8 Drawing Sheets

(56) References Cited

U.S. PATENT DOCUMENTS

| | | | | |
|---|---|---|---|---|
| 8,565,860 | B2 | 10/2013 | Kimchy et al. | |
| 8,646,520 | B2 | 2/2014 | Chen | |
| 8,674,290 | B2 | 3/2014 | Masnyk et al. | |
| 8,754,362 | B2 | 6/2014 | Smaardyk et al. | |
| 8,800,880 | B2 | 8/2014 | Christiansen | |
| 9,002,648 | B2 | 4/2015 | Pfutzner | |
| 2003/0000300 | A1 | 1/2003 | Wong | |
| 2003/0098799 | A1 | 5/2003 | Zimmerman | |
| 2004/0020643 | A1* | 2/2004 | Thomeer | E21B 47/01 166/250.01 |
| 2004/0226805 | A1* | 11/2004 | Lodge | B65G 43/02 198/810.02 |
| 2008/0042869 | A1 | 2/2008 | Zimmerman | |
| 2008/0156977 | A1 | 7/2008 | Jeffryes | |
| 2009/0151939 | A1 | 6/2009 | Bailey et al. | |
| 2010/0089571 | A1 | 4/2010 | Revellat et al. | |
| 2011/0132607 | A1 | 6/2011 | Lahitette et al. | |
| 2011/0297371 | A1 | 12/2011 | Church et al. | |
| 2012/0138291 | A1 | 6/2012 | Tomberlin et al. | |
| 2013/0008646 | A1 | 1/2013 | Blount | |
| 2013/0008650 | A1 | 1/2013 | Blount | |
| 2013/0105679 | A1 | 5/2013 | Climent | |
| 2013/0153212 | A1 | 6/2013 | Myers | |
| 2017/0176180 | A1* | 6/2017 | Merino | E21B 17/006 |
| 2018/0135407 | A1* | 5/2018 | Donald | G01V 5/04 |

FOREIGN PATENT DOCUMENTS

| | | | |
|---|---|---|---|
| GB | 2489125 | A | 9/2012 |
| WO | 2011071809 | A1 | 6/2011 |
| WO | 2014131132 | A2 | 9/2014 |
| WO | 2015020530 | A2 | 2/2015 |

* cited by examiner

RADIOACTIVE TAG DETECTION FOR DOWNHOLE POSITIONING

CROSS-REFERENCE TO RELATED APPLICATIONS

This application is a national stage entry of PCT/US2016/013084 filed Jan. 12, 2016, said application is expressly incorporated herein in its entirety.

TECHNICAL FIELD

The present technology pertains to positioning of downhole tools, and more particularly to positioning of downhole tools via radioactive tag detection.

BACKGROUND

After an oil or gas well has been drilled, well operators often carry out various tasks to prepare the well for production of hydrocarbons. These tasks, known as completion operations, typically include inserting and cementing a casing or liner within the wellbore to prevent the walls of the wellbore from caving in. A downhole tool, such as a perforating gun, can then be conveyed downhole via a wireline or a wellbore tubular and positioned adjacent to a formation of interest. Once in position, one or more packers can be set, and explosive charges within the perforating gun can be fired to create holes, or perforations, within the casing, the cement, and the formation. In this manner, fluid communication between the wellbore and the formation can be established.

However, accurately positioning the downhole tool at the intended downhole location relies heavily on the ability to correctly determine the downhole position of the tool in relation to the formation of interest. Current solutions measure the length of the wellbore tubular as it conveyed downhole to determine when the downhole tool has reached the known depth of the formation. Unfortunately, these solutions are subject to improper or inaccurate measurements of the length of the wellbore tubular due to inconsistent lengths of tubulars, tubular stretch and compression, well deviations, and the like, resulting in erroneous placement of the downhole tool. Other solutions conduct additional logging runs to collect well logs which can be used to correlate the position of the downhole tool with the depth of the well. However, these logging runs often necessitate the removal of the wellbore tubular to deploy a wireline logging tool within the wellbore. Further, the additional logging runs required by these solutions are very expensive and time consuming, especially in offshore applications.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
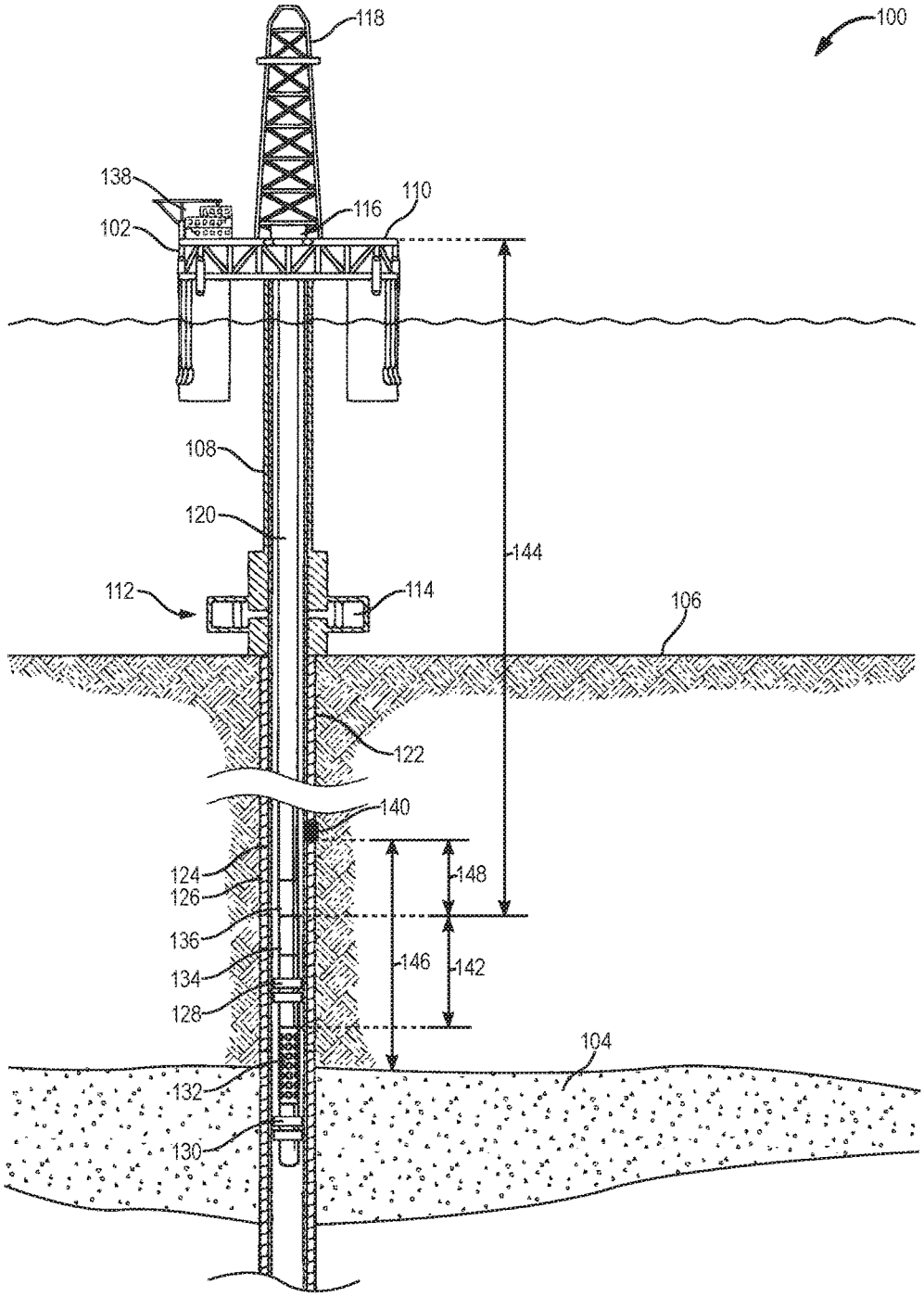
FIG. 1 illustrates a schematic diagram of an example system for positioning of downhole tools.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The phrase "wellbore tubular" is defined as one or more types of connected tubulars, and can include, but is not limited to, drill string, tool string, completion string, production string, tubing, production tubing, jointed tubing, coiled tubing, casings, liners, drill pipe, combinations thereof, or the like. The term "coupled" is defined as connected, whether directly or indirectly through intervening components, and is not necessarily limited to physical connections. Further, the use of directional terms such as above, below, upper, lower, upward, downward, uphole, downhole and the like are used in relation to the illustrative embodiments as they are depicted in the figures, the upward or uphole direction being toward the surface of the well, the downward or downhole direction being toward the bottom of the well.

The approaches set forth herein describe systems and methods quickly determining the position of a wellbore tubular and its components in relation to a radioactive tag disposed in within a wellbore. The system includes one or more radiation detectors disposed on a wellbore tubular and configured to detect a radioactive tag within a wellbore. By detecting the radioactive tag, the wellbore tubular can be correlated to the depth of the tag, and the downhole position of the wellbore tubular components in relation to a formation of interest can be known. This critical position information can be communicated to a surface of the wellbore (e.g., through telemetry), stored for later verification, and/or used to automatically activate downhole tools once they are at the proper location within the wellbore.

Disclosed are systems and methods for positioning of downhole tools via radioactive tag detection. The method comprises positioning a radiation detector at a first position within a wellbore, logging radiation data while the radiation detector is moved from the first position to a position adjacent to or past a radioactive marker disposed within the wellbore, determining, based on the radiation data, a time at which the radiation detector is adjacent to the radioactive marker, and calculating, based on the time, a distance between the first position of the radiation detector and the radioactive marker.

The present disclosure is described in relation to an offshore well operation 100 depicted schematically in FIG. 1. A semi-submersible platform 102 is centered over a submerged formation 104 located below sea floor 106. A subsea conduit 108 extends from a surface 110 of platform 102 to a wellhead installation 112, including blowout preventers 114. Platform 102 has a hoisting apparatus 116 and a derrick 118 for raising and lowering wellbore tubulars, such as wellbore tubular 120.

Continuing with FIG. 1, a wellbore 122 extends through the various earth strata including formation 104. At least a portion of a casing 124 can be cemented within wellbore 122 by cement 126. Note that, in this specification, the terms "liner" and "casing" are used interchangeably to describe one or more layers of tubular materials which are used to form protective linings in wellbores. Liners and casings may be made from any material such as metals, plastics, composites, or the like, may be expanded or unexpanded as part of an installation procedure, and may be segmented or continuous. Additionally, it is not necessary for a liner or casing to be cemented in a wellbore. Any type of liner or casing may be used in keeping with the principles of the present invention.

Wellbore tubular 120 can be raised or lowered within wellbore 122 to conduct various operations on one or more formations of interest, such as formation 104. Moreover, wellbore tubular 120 can include various wellbore components to support such operations. For example, wellbore tubular 120 can include one or more packers 128, 130 to provide zonal isolation for the production of hydrocarbons in certain formation of interest within wellbore 122. When set, packers 128, 130 can isolate zones of the annulus between wellbore tubular 120 and wellbore 122. In this manner, formation fluids, such as those from formation 104, may enter the annulus between wellbore tubular 120 and wellbore 122 in between packers 128, 130.

Wellbore tubular 120 can also include one or more downhole tools, such as a perforating gun 132. Wellbore tubular 120 can be moved within wellbore 122 to position perforating gun 132 adjacent to a formation of interest, such as formation 104. Once in position, a string of shaped charges within perforating gun 132 can be fired to create holes, or perforations, within casing 124, cement 126, and/or formation 104. In this manner, fluid communication between formation 104 and wellbore 122 can be established.

As noted above, accurately positioning a downhole tool at the intended downhole location relies heavily on the ability to correctly determine the downhole position of the tool in relation to the formation of interest. Measuring the length of the wellbore tubular as it conveyed downhole often results in an inaccurate determination of the depth of the downhole tool. Further, additional logging runs to correlate the position of the downhole tool with the depth of the well are very expensive and time consuming and often necessitate the removal of the wellbore tubular to deploy a wireline logging tool within the wellbore. Accordingly, the systems and techniques disclosed herein allow for the positioning of a downhole tool using radioactive tag detection.

For example, FIG. 1 illustrates a radiation detector 134 coupled with wellbore tubular 120. Radiation detector 134 can be a gamma ray detector configured to measure the radioactivity within wellbore 122 and its surrounding formations and devices. For instance, radiation detector 134 can include a scintillator, such as thallium-doped sodium-iodide, coupled with a photomultiplier and one or more processors and/or storage devices. When gamma rays emitted by radioactive materials within wellbore 122 and its surrounding formations/devices enter radiation detector 134, their energy can be absorbed by the scintillator and re-emitted in the form of light. The light can be detected by the photomultiplier, which can convert the light energy into an electric pulse. By measuring the number of electric pulses per unit time, referred to herein as "counts", radiation detector 134 can determine the intensity of the radiation at a given depth within wellbore 122.

Radiation detector 134 can be coupled with a downhole tools unit 136 disposed on wellbore tubular 120. Downhole tools unit 136 can be located at a downhole location within wellbore 122 and can include one or more processors and storage devices to process and/or store data received from radiation detector 134, as well as to send instructions to radiation detector 134. Further, downhole tools unit 136 can include a downhole telemetry tool configured to communicate with a surface telemetry tool included within a surface tools unit 138 located at a surface location of wellbore 122 (e.g., surface 110). Communication between tools units 136, 138 can include any technique known in the art, such as by acoustic telemetry, optical telemetry, electromagnetic telemetry, pulse telemetry, electrical lines, and the like. In this manner, tools units 136, 138 can enable bidirectional communication between surface 110 of platform 102 and downhole devices located within wellbore 122 (e.g., packers 128, 130, perforation gun 132, radiation detector 134, downhole tools unit 136, etc.). Moreover, tools units 136, 138 can enable radiation detector 134 to send measured radiation data to surface 110 of platform 102 in real-time for processing, storage, and/or analysis by one or more processors and storage devices included within surface tools unit 138 and/or disposed at a remote location.

In operation, wellbore tubular 120 can be raised or lowered to dispose a downhole tool, such as perforating gun 132, at an initial position within wellbore 122. The initial position of perforating gun 132 can be broken into two components: a known distance 142 between perforating gun 132 and radiation detector 134, and a measured distance 144 between radiation detector 134 and surface 110. Known distance 142 can be determined, for example, by measuring the fixed length between perforating gun 132 and radiation detector 134 prior to lowering wellbore tubular 120 below surface 110. Measured distance 144 can be determined, for example, by measuring the length of wellbore tubular 120 between radiation detector 134 and surface 110 as wellbore tubular 120 is deployed downhole. However, as previously discussed, measuring the length of wellbore tubular 120 as it is deployed below surface 110 is not a reliable indicator of the actual downhole position of wellbore tubular 120 and its associated components due to factors such as inconsistent lengths of tubulars, tubular stretch and compression, well deviations, and the like.

Accordingly, a radioactive tag 140 can be placed within casing 124, cement 126, and/or the formation surrounding wellbore 122. Radioactive tag 140 can be a radioactive pip tag, although those skilled in the art will appreciate that any radioactive marker capable of providing a detectable radioactive signature can be used. A distance between radioactive tag 140 and a formation of interest can be known and verified, for example, through one or more previously conducted well logging runs. For instance, FIG. 1 illustrates a known distance 146 between radioactive tag 140 and formation 104. Thus, by correlating the depth of wellbore tubular 120 with the depth of radioactive tag 140, an accurate relationship between formation 104 and the downhole position of wellbore tubular 120 can be established.

Such a relationship can be established, for example, by correlating the depth of radiation detector 134 with the depth of radioactive tag 140. To do so, radiation detector 134 can be disposed at an initial position within wellbore 122 having an unknown distance above or below radioactive tag 140. For example, FIG. 1 depicts radiation detector 134 located at an unknown distance 148 below radioactive tag 140 when disposed at an initial position at measured distance 144 below surface 110.

From the initial position, radiation detector 134 can be activated to collect logs, such as gamma ray logs, of the radiation intensity within wellbore 122 and its surrounding formations beginning at an initial time, $T_0$. In some cases, radiation detector 134 can receive an activation signal from downhole tools unit 136, surface tools unit 138, and/or stored instructions which enables radiation detector 134 to begin measuring the radiation intensity. From here, the measured data can be processed and/or stored within radiation detector 134, and/or sent from radiation detector 134 to downhole tools unit 136 and/or surface tools unit 138 for processing, storage, and/or analysis. In other cases, radiation detector 134 can continuously measure the radiation intensity within wellbore 122 and its surrounding formations, and an indication of the initial time $T_0$ can be made on the logs of the measured data.

Once radiation detector 134 is activated, wellbore tubular 120 can be raised or lowered to move radiation detector 134 from its initial position to a second position that is adjacent to or past radioactive tag 140. The second position can be a predetermined distance from the initial position (e.g., wellbore tubular 120 can be raised/lowered a predetermined distance, raised/lowered for a predetermined time, etc.), or the second position can be dynamically determined based on real-time analysis of the radiation intensity logs as wellbore tubular 120 is moved within wellbore 122.

Figure 2:
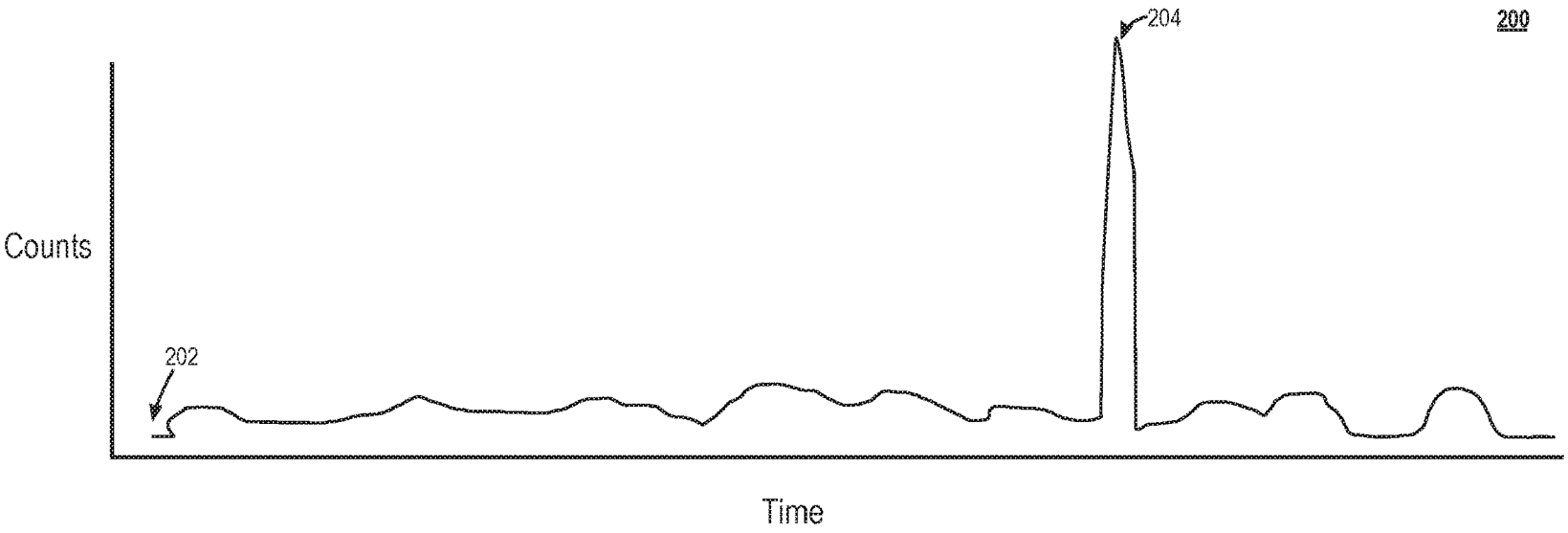
FIG. 2 illustrates a graphical representation of a gamma ray log for a radiation detector.

As radiation detector 134 is moved to the second position adjacent to or past radioactive tag 140, the gamma ray counts measured by radiation detector 134 can be recorded as a function of time. For example, FIG. 2 illustrates an exemplary gamma ray log 200 produced from the measurements taken by radiation detector 134 as wellbore tubular 120 is moved from its initial position to a second position where radiation detector 134 is past radioactive tag 140. Such a log can be produced, for example, by one or more processors, storage units, and/or software modules within tools units 136, 138 and/or radiation detector 134. As illustrated, gamma ray log 200 begins at an initial time $T_0$ (202) which can correspond to the time at which radiation detector 134 is at its initial position (e.g., an initial position at measured distance 144 below surface 110). The counts measured by radiation detector 134 can change over time as wellbore tubular 120 is moved within wellbore 122, with a relative maximum in the measured counts occurring at a time $T_{tag}$ (204). By comparing the measured counts to a threshold value or otherwise analyzing gamma ray log 200, it can be determined that time $T_{tag}$ (204) corresponds to the time at which radiation detector 134 is adjacent to radioactive tag 140.

Using the information from gamma ray log 200, unknown distance 148 between radioactive tag 140 and the initial position of radiation detector 134 can be calculated. As a non-limiting example, unknown distance 148 can be calculated using equation (1) below, where D is the unknown distance (e.g., unknown distance 148), $T_{tag}$ is the time at which radiation detector 134 is adjacent to radioactive tag 140 (e.g., $T_{tag}$ 204), $T_0$ is the time at which radiation detector 134 is at its initial position (e.g., $T_0$ 202), and V is the velocity of radiation detector 134 between times $T_0$ and $T_{tag}$.

$$D=(T_{tag}-T_0)*V \tag{1}$$

In some cases, the velocity V can be a predetermined constant velocity. For example, wellbore tubular 120 can be raised or lowered at a constant velocity between times $T_0$ and $T_{tag}$, and velocity V can be assumed to be equivalent to the constant velocity of wellbore tubular 120. In other cases, the velocity V between times $T_0$ and $T_{tag}$ can be measured or calculated. Moreover, in some cases, one or more accelerometers can be included within radiation detector 134, within downhole tools unit 136, and/or elsewhere on wellbore tubular 120 and can measure the acceleration of wellbore tubular 120 between times $T_0$ and $T_{tag}$. The measured acceleration data, as well as other known data, can then be used to calculate, qualify, and/or modify the velocity V between times $T_0$ and $T_{tag}$.

Once unknown distance 148 between radioactive tag 140 and the initial position of radiation detector 134 is calculated, the depth of radiation detector 134 can be correlated with the depth of radioactive tag 140. In this manner, an accurate relationship between formation 104 and the downhole position of wellbore tubular 120 and its associated components can be established. For example, the calculated distance 148 can be used to offset measured distance 144 so that measured distance 144 corresponds to the depth of the radioactive tag 140. From here, one or more downhole tools and/or other components disposed on wellbore tubular 120 can be positioned downhole using the known relationship between radioactive tag 140 and formation 104 (e.g., known distance 146) and one or more known distances between radiation detector 134 and the other components of wellbore tubular 120 (e.g., known distance 142). For example, once correlated, wellbore tubular 120 can be raised or lowered to position perforating gun 132 adjacent to formation 104 using known distances 142 and 146. Further, wellbore tubular 120 can be raised or lowered to position packers 128, 130 above and/or below formation 104 using known distance 146 and known distances between radiation detector 134 and packers 128, 130. Once in position, packers 128, 130 can be set (automatically or manually), and perforating gun 132 can be fired (automatically or manually) to perforate casing 124, cement 126, and/or formation 104.

Figure 3:
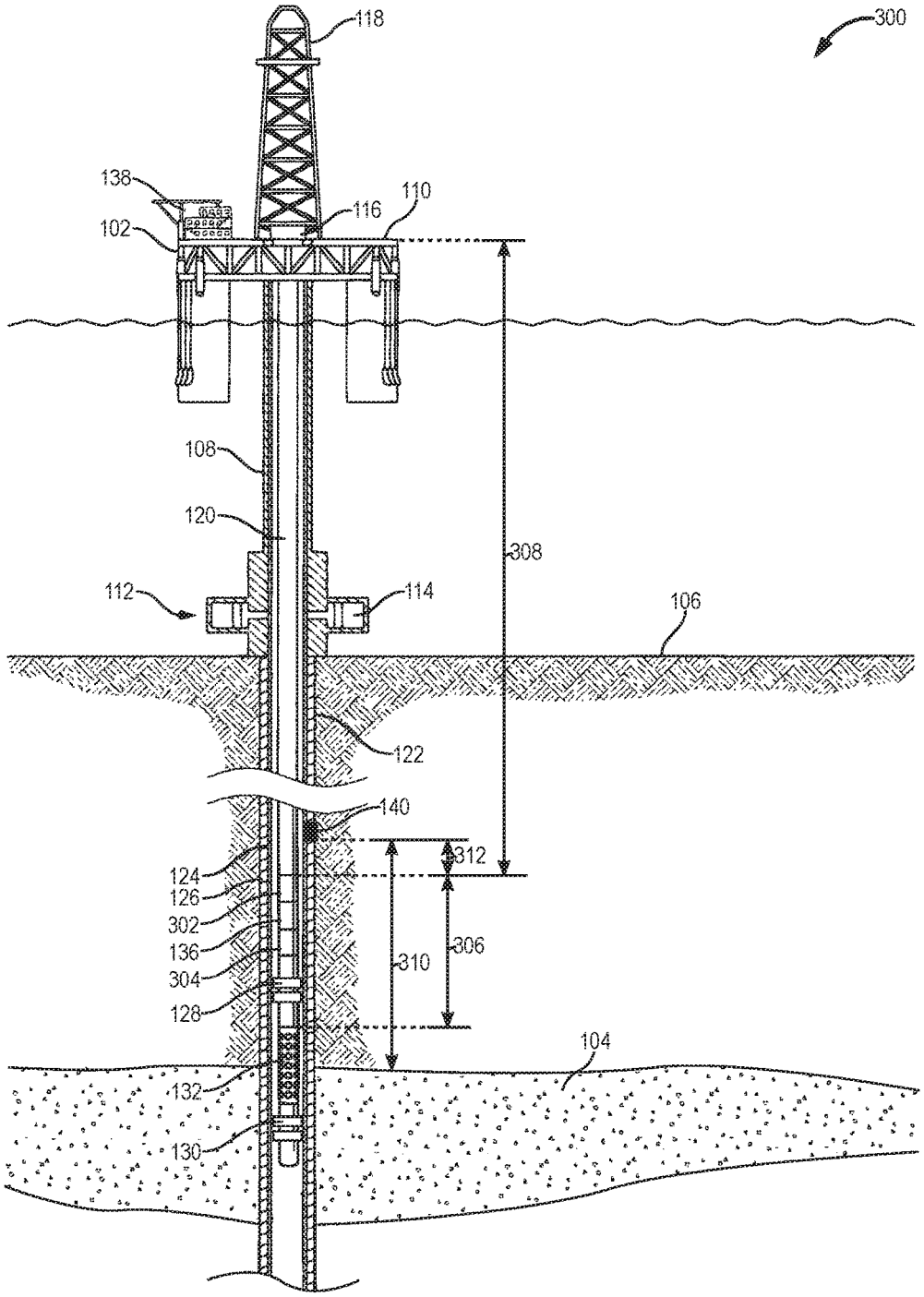
FIG. 3 illustrates a schematic diagram of another example system for positioning of downhole tools.

FIG. 3 illustrates a schematic diagram of an offshore well operation 300. Well operation 300 is substantially similar to well operation 100 and therefore, to avoid repetition, only the differences between the two will be described. As illustrated, well operation 300 includes a first radiation detector 302 and a second radiation detector 304. Radiation detectors 302, 304 are separated by a known distance and can each be a gamma ray detector configured to measure the radioactivity within wellbore 122 and its surrounding formations and devices. Each of radiation detectors 302, 304 can include one or more processors and storage devices to process and store measured data, execute instructions, and the like. Further, each of radiation detectors 302, 304 can be coupled with a downhole tools unit 136 configured for bidirectional communication with a surface tools unit 138. In this manner, each of radiation detectors 302, 304 can receive instructions from a surface 110 and can send measured data to surface 110 in real-time.

As previously discussed, wellbore tubular 120 can be raised or lowered to dispose a downhole tool, such as perforating gun 132, at an initial position within wellbore 122. The initial position of perforating gun 132 can be broken into two components, including a known distance 306 between perforating gun 132 and radiation detector 302, and a measured distance 308 between radiation detector 302 and surface 110. Further, a distance 310 between radioactive tag 140 and a formation 104 can be known and verified, for example, through one or more previously conducted well logging runs.

To establish an accurate relationship between formation 104 and the downhole position of wellbore tubular 120 and its associated components, one or more of radiation detectors 302, 304 can be correlated with radioactive tag 140. To do so, radiation detectors 302, 304 can be disposed at respective initial positions within wellbore 122 having unknown distances above or below radioactive tag 140. For example, FIG. 3 depicts radiation detector 302 located at an unknown distance 312 below radioactive tag 140 when disposed at an initial position at measured distance 308 below surface 110.

From the initial positions, radiation detectors 302, 304 can be activated to collect logs, such as gamma ray logs, of the radiation intensity within wellbore 122 and its surrounding formations beginning at an initial time, $T_0$. Once radiation detectors 302, 304 are activated, wellbore tubular 120 can be raised or lowered to move radiation detectors 302, 304 from their initial positions to secondary positions. In cases where the initial positions of radiation detectors 302, 304 are both above radioactive tag 140, radiation detector 304 can be moved to a secondary position below radioactive tag 140, and radiation detector 302 can be moved to a secondary position adjacent to or below radioactive tag 140. In cases where the initial positions of radiation detectors 302, 304 are both below radioactive tag 140, radiation detector 302 can be moved to a secondary position above radioactive tag 140, and radiation detector 304 can be moved to a secondary position adjacent to or above radioactive tag 140.

Figure 4:
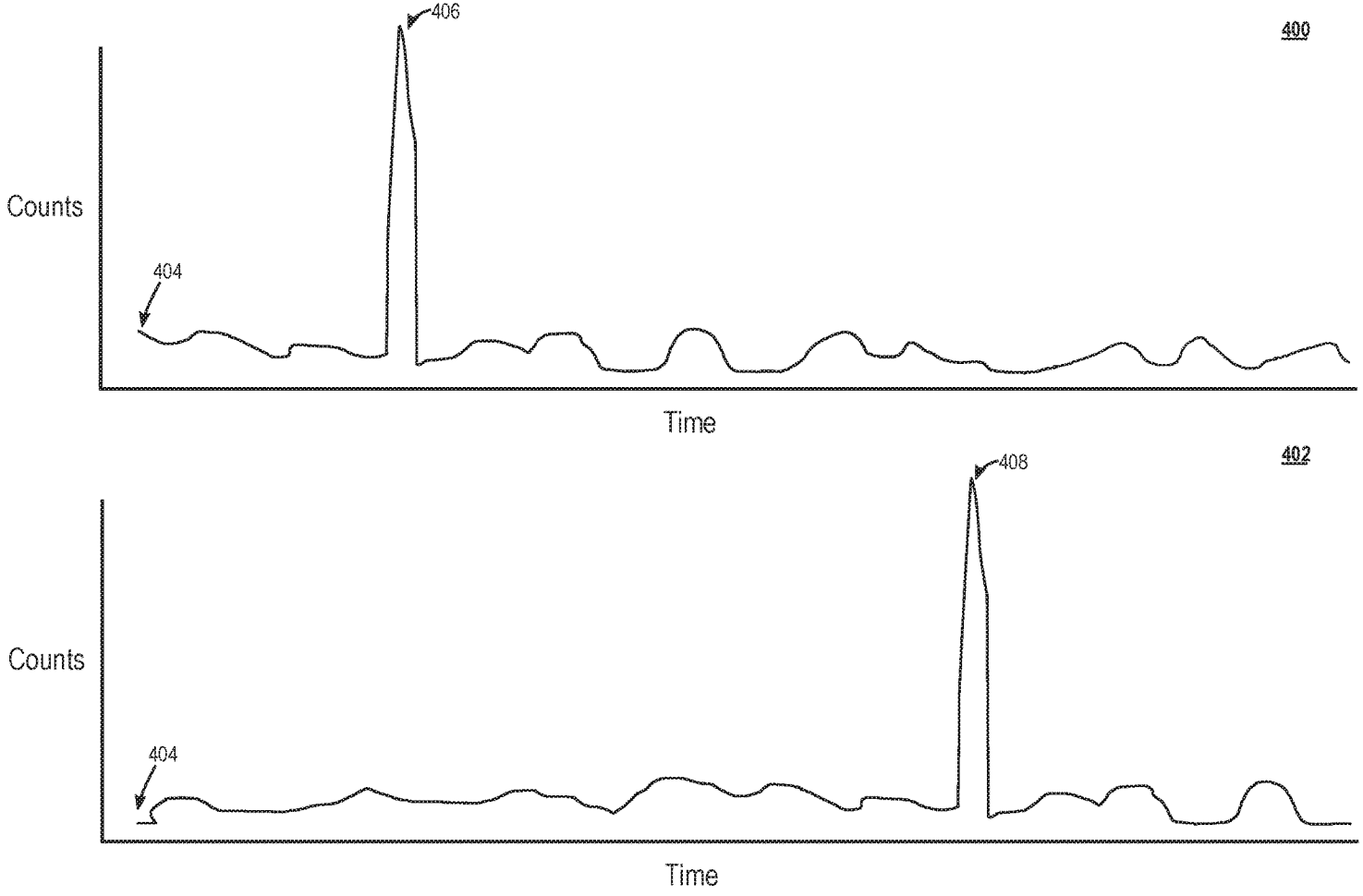
FIG. 4 illustrates graphical representations of gamma ray logs for two radiation detectors.

As radiation detectors 302, 304 are moved to their respective secondary positions, the gamma ray counts measured by each of radiation detectors 302, 304 can be recorded as a function of time. For example, FIG. 4 illustrates exemplary gamma ray logs 400, 402 produced from the measurements taken by radiation detectors 302, 304, respectively, as wellbore tubular 120 is moved from its initial position to a second position. Gamma ray logs 400, 402 can begin at an initial time $T_0$ (404) which can correspond to the time at which radiation detectors 302, 304 are at their initial positions. The counts measured by radiation detectors 302, 304 can change over time as wellbore tubular 120 is moved within wellbore 122, with a relative maximum in the measured counts occurring at a time $T_{tag1}$ (406) for radiation detector 302 and at time $T_{tag2}$ (408) for radiation detector 304. By comparing the measured counts to a threshold value or otherwise analyzing gamma ray logs 400, 402, it can be determined that time $T_{tag1}$ (406) corresponds to the time at which radiation detector 302 is adjacent to radioactive tag 140, and time $T_{tag2}$ (408) corresponds to the time at which radiation detector 304 is adjacent to radioactive tag 140.

Using the information from gamma ray logs 400, 402, a velocity of wellbore tubular 120 as it is moved from its initial position to its second position can be calculated. In particular, the velocity of wellbore tubular 120 between times $T_{tag1}$ (406) and $T_{tag2}$ (408) can be calculated. As a non-limiting example, the velocity can be calculated using equation (2) below, where $V_{calculated}$ is the velocity of wellbore tubular 120 between times $T_{tag1}$ and $T_{tag2}$, $D_{rd}$ is the known distance between radiation detectors 302, 304, $T_{tag1}$ is the time at which radiation detector 302 is adjacent to radioactive tag 140 (e.g., $T_{tag1}$ 406), and $T_{tag2}$ is the time at which radiation detector 304 is adjacent to radioactive tag 140 (e.g., $T_{tag2}$ 408).

$$V_{calculated} = \frac{D_{rd}}{(T_{tag2} - T_{tag1})} \tag{2}$$

Using the calculated velocity $V_{calculated}$, the unknown distance 312 between radioactive tag 140 and the initial position of radiation detector 302 can be calculated. As a non-limiting example, unknown distance 312 can be calculated using equation (3) below, where D is the unknown distance (e.g., unknown distance 312), $T_{tag1}$ is the time at which radiation detector 302 is adjacent to radioactive tag 140 (e.g., $T_{tag1}$ 406), $T_{tag2}$ is the time at which radiation detector 304 is adjacent to radioactive tag 140 (e.g., $T_{tag2}$ 408), $T_0$ is the time at which radiation detectors 302, 304 are at their initial positions (e.g., $T_0$ 404), and $V_{calculated}$ is the velocity of wellbore tubular 120 between times $T_{tag1}$ and $T_{tag2}$.

$$D=(T_{tag2}-T_0)*V_{calculated}=(T_{tag1}-T_0)*V_{calculated}-D_{rd} \tag{3}$$

In some cases, one or more accelerometers can be included within radiation detectors 302, 304, within downhole tools unit 136, and/or elsewhere on wellbore tubular 120 and can measure the acceleration of wellbore tubular 120 as it is moved within wellbore 122. The measured acceleration data, as well as other known data, can then be used to qualify and/or modify the velocity $V_{calculated}$ and can enhance the calculation by extrapolating velocities that are not constant.

Once unknown distance 312 between radioactive tag 140 and the initial position of radiation detector 302 is calculated, the depth of radiation detector 302 and/or radiation detector 304 can be correlated with the depth of radioactive tag 140. In this manner, an accurate relationship between formation 104 and the downhole position of wellbore tubular 120 and its associated components can be established. For example, the calculated distance 312 can be used to offset measured distance 308 so that measured distance 308 corresponds to the depth of the radioactive tag 140. From here, one or more downhole tools and/or other components disposed on wellbore tubular 120 can be positioned downhole using the known relationship between radioactive tag 140 and formation 104 (e.g., known distance 310) and one or more known distances between radiation detectors 302, 304 and the other components of wellbore tubular 120 (e.g., known distance 306). For example, once correlated, wellbore tubular 120 can be raised or lowered to position perforating gun 132 adjacent to formation 104 using known distances 306 and 310. Further, wellbore tubular 120 can be raised or lowered to position packers 128, 130 above and/or below formation 104 using known distance 310 and known distances between radiation detectors 302, 304 and packers 128, 130. Once in position, packers 128, 130 can be set (automatically or manually), and perforating gun 132 can be fired (automatically or manually) to perforate casing 124, cement 126, and/or formation 104.

Although FIG. 1 depicts an offshore operation, it should be understood by those skilled in the art that the present disclosure is equally well suited for use in onshore operations. Further, even though FIG. 1 depicts a specific wellbore configuration, it should be understood by those skilled in the art that the present disclosure is equally well suited for use in wellbores having other orientations including vertical wellbores, slanted wellbores, multilateral wellbores and the like.

Moreover, it should be noted that the configurations and distances described in relation to the figures are for purposes of explanation and are not intended to limit the scope of the disclosure. For example, the downhole tools unit (e.g., downhole tools unit 136) can be separate from radiation detector (e.g., radiation detector 134) as illustrated, or can be included within the radiation detector to for a single unit. Further, the initial position of radiation detector(s) can be above the radioactive tag and is not limited to being below the radioactive tag as illustrated. In addition, well operations 100, 300 are not limited to perforation operations as described, but can also include other operations such as inspection, evaluation, analysis, collection, stimulation, perforation, and the like. To support such operations, wellbore tubular can include any number of components, and can include different components than those depicted in the figures. Moreover, the processes described herein can be executed manually (e.g., by user interaction), automatically (e.g., by one or more processors and storage devices controlling the well operations), or a combination of both.

Figure 5:
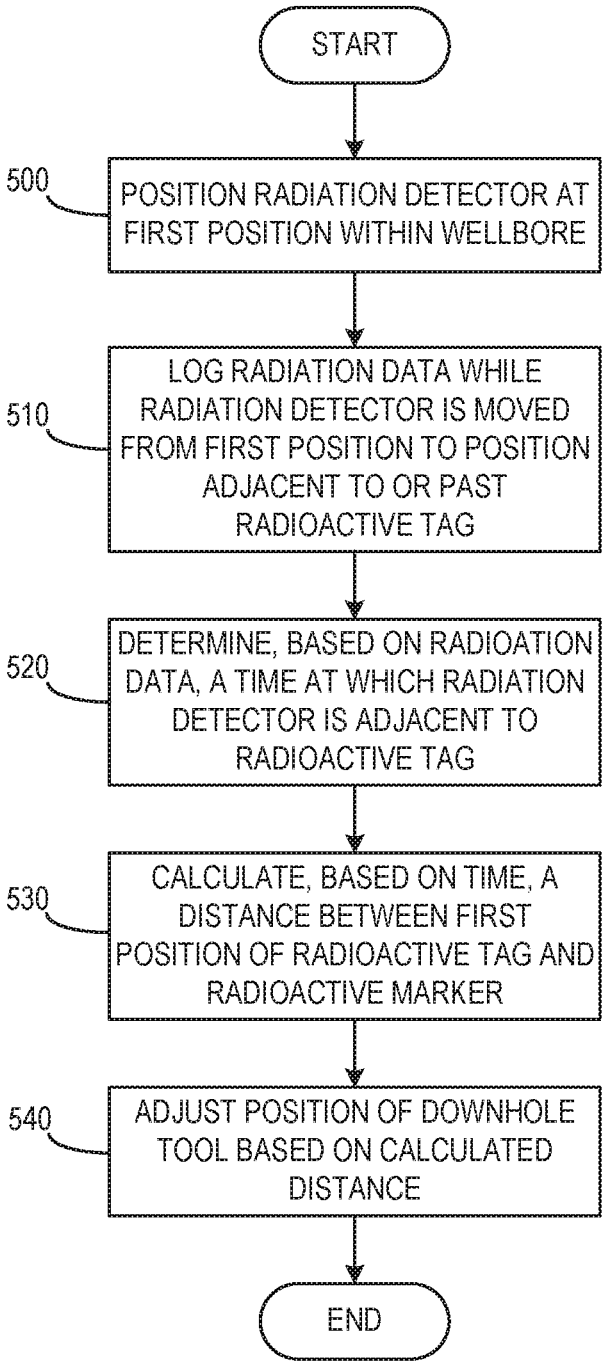
FIG. 5 illustrates an exemplary method embodiment for positioning a downhole tool using a single radiation detector.
Figure 6:
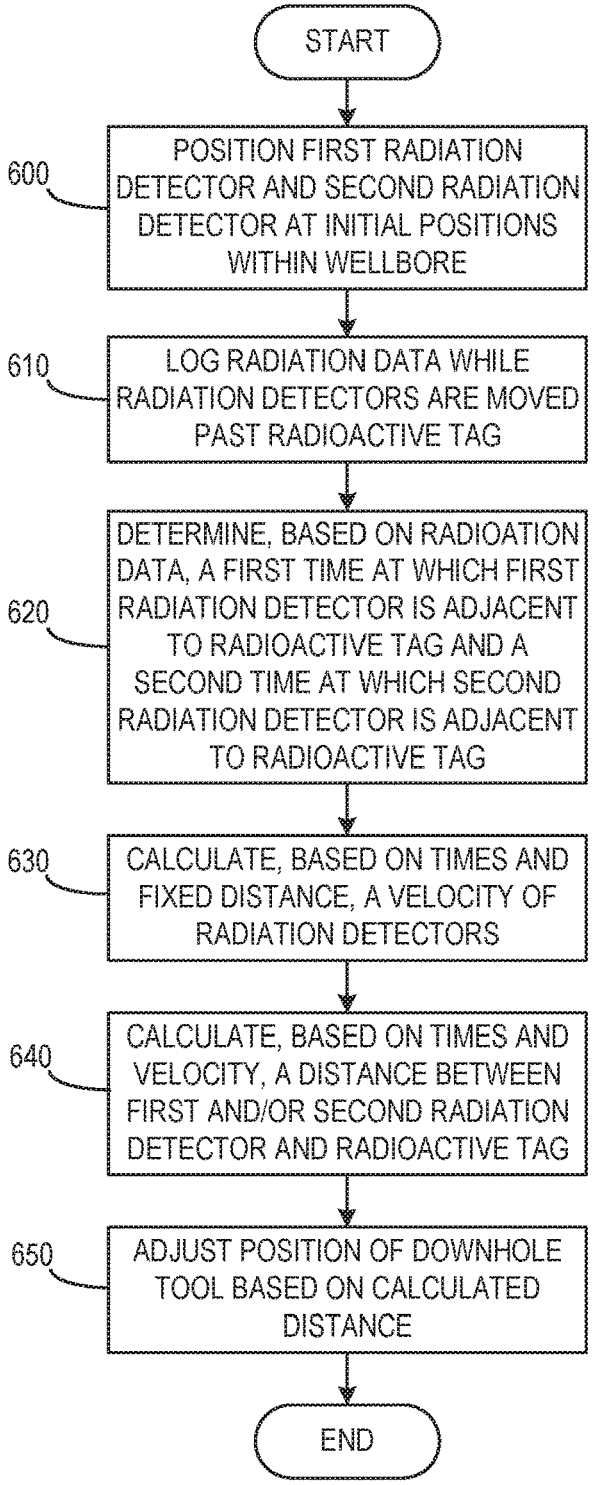
FIG. 6 illustrates an exemplary method embodiment for positioning a downhole tool using two radiation detectors.

Having disclosed some basic system components and concepts, the disclosure now turns to the example method embodiments shown in FIGS. 5-6. The steps outlined herein can be implemented in any combination thereof, including combinations that exclude, add, or modify certain steps.

FIG. 5 illustrates an example process for positioning a downhole tool using a single radiation detector. At step 500, a radiation detector, such as radiation detector 134, can be positioned at a first position within a wellbore. The radiation detector can be coupled with a wellbore tubular, and positioning the radiation detector can include raising or lowering the wellbore tubular within the wellbore. The radiation detector can be activated at the first position to begin measuring the radiation intensity data within the wellbore. From here, the radiation detector can be moved from the first position to a position adjacent to or past a radioactive tag, such as radioactive tag 140, disposed within the wellbore (step 510). The radiation data collected by radiation detector can be used to produce a log, such as a gamma ray log.

At step 520, a time at which the radiation detector is at a position adjacent to the radioactive tag can be determined. Such a determination can be made through analysis of the log created in step 510 by one or more processors and storage devices or by a user. Next, at step 530, a distance between the first position of the radiation detector and the radioactive tag can be calculated based on the time determined in step 520. The calculation of the distance can also include other information, such as a constant or measured velocity of the radiation detector as it is moved within the wellbore, acceleration data, and the like. Once calculated, the distance can be used to correlate the wellbore tubular and its components with the radioactive tag. By correlating the downhole position, a position of a downhole tool, such as perforating gun 132, can be adjusted so that it is properly located in relation to a formation of interest, such as formation 104 (step 540).

FIG. 6 illustrates an example process for positioning a downhole tool using a single radiation detector. At step 600, a first radiation detector, such as radiation detector 302, and a second radiation detector, such as radiation detector 304, can be positioned at respective initial positions within a wellbore. The radiation detectors can be coupled with a wellbore tubular, and positioning the radiation detectors can include raising or lowering the wellbore tubular within the wellbore. The radiation detectors can be located at a fixed distance from one another on the wellbore tubular. The radiation detectors can be activated at the initial positions to begin measuring the radiation intensity data within the wellbore. From here, the radiation detectors can be moved from the initial positions to secondary positions past a radioactive tag, such as radioactive tag 140, disposed within the wellbore (step 610). The radiation data collected by radiation detectors can be used to produce one or more logs, such as a gamma ray logs.

At step 620, a first time at which the first radiation detector is at a position adjacent to the radioactive tag and a second time at which the second radiation detector is at a position adjacent to the radioactive tag can be determined. Such a determination can be made through analysis of the log(s) created in step 610 by one or more processors and storage devices or by a user. Next, at step 630, a velocity of the radiation detectors can be calculated between the first and second times based on the fixed distance between the radiation detectors and the first and second times. Subsequently, at step 640, a distance between the initial position of at least one of the radiation detectors and the radioactive tag can be calculated based on the times determined in step 620 and the velocity determined in step 630. The calculation of the distance can also include other information, such as a constant or measured velocity of the radiation detector as it is moved within the wellbore, acceleration data, and the like. Once calculated, the distance can be used to correlate the wellbore tubular and its components with the radioactive tag. By correlating the downhole position, a position of a downhole tool, such as perforating gun 132, can be adjusted so that it is properly located in relation to a formation of interest, such as formation 104 (step 640).

Figure 7A:
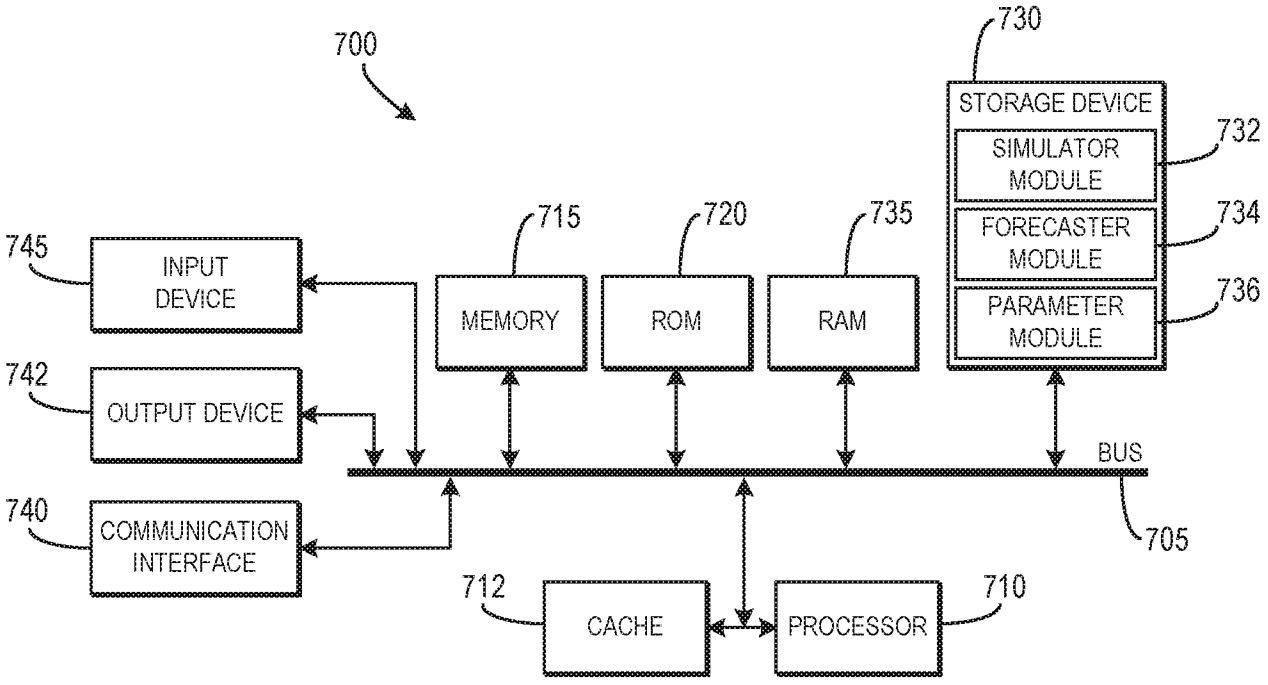
FIGS. 7A and 7B illustrate schematic diagrams of example computing systems for use with example system embodiments.
Figure 7B:
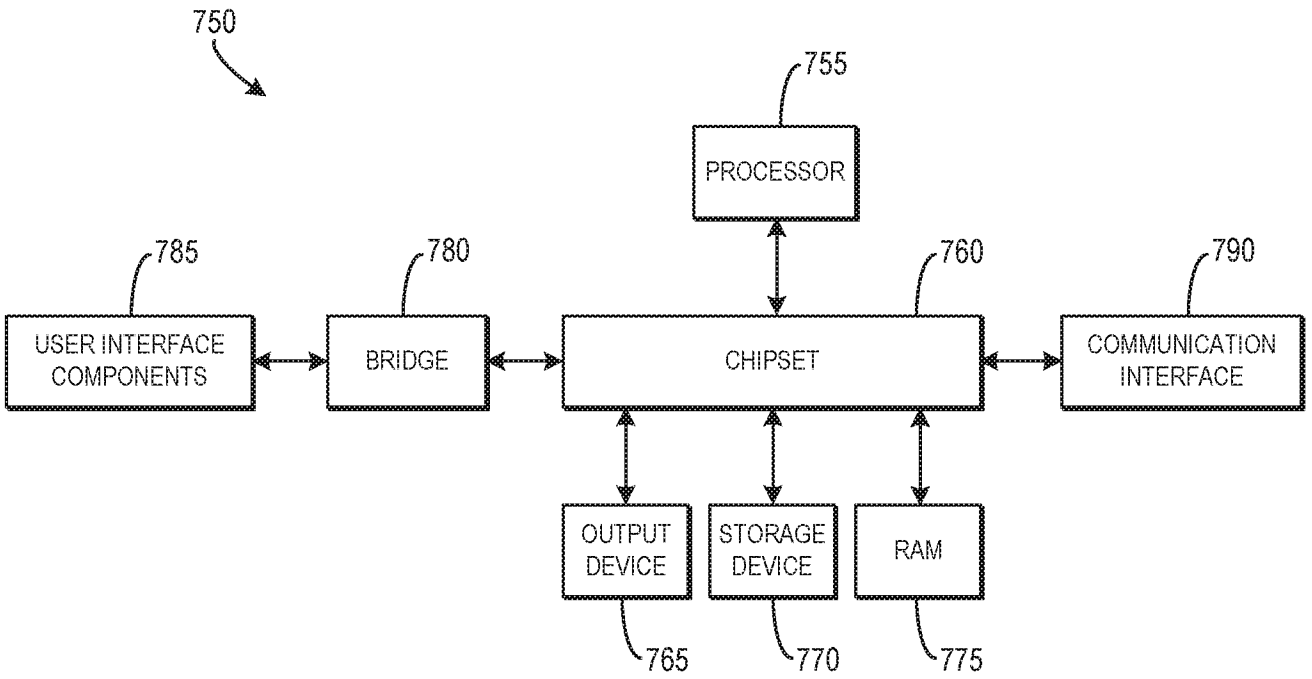

FIG. 7A and FIG. 7B illustrate example computing systems for use with example system embodiments. The more appropriate embodiment will be apparent to those of ordinary skill in the art when practicing the present technology. Persons of ordinary skill in the art will also readily appreciate that other system embodiments are possible.

FIG. 7A illustrates a conventional system bus computing system architecture 700 wherein the components of the system are in electrical communication with each other using a bus 705. System 700 can include a processing unit (CPU or processor) 710 and a system bus 705 that couples various system components including the system memory 715, such as read only memory (ROM) 720 and random access memory (RAM) 725, to the processor 710. The system 700 can include a cache of high-speed memory connected directly with, in close proximity to, or integrated as part of the processor 710. The system 700 can copy data from the memory 715 and/or the storage device 730 to the cache 712 for quick access by the processor 710. In this way, the cache can provide a performance boost that avoids processor 710 delays while waiting for data. These and other modules can control or be configured to control the processor 710 to perform various actions. Other system memory 715 may be available for use as well. The memory 715 can include multiple different types of memory with different performance characteristics. The processor 710 can include any general purpose processor and a hardware module or software module, such as module 1 732, module 2 734, and module 3 736 stored in storage device 730, configured to control the processor 710 as well as a special-purpose processor where software instructions are incorporated into the actual processor design. The processor 710 may essentially be a completely self-contained computing system, containing multiple cores or processors, a bus, memory controller, cache, etc. A multi-core processor may be symmetric or asymmetric.

To enable user interaction with the computing device 700, an input device 745 can represent any number of input mechanisms, such as a microphone for speech, a touch-sensitive screen for gesture or graphical input, keyboard, mouse, motion input, speech and so forth. An output device 742 can also be one or more of a number of output mechanisms known to those of skill in the art. In some instances, multimodal systems can enable a user to provide multiple types of input to communicate with the computing device 700. The communications interface 740 can generally govern and manage the user input and system output. There is no restriction on operating on any particular hardware arrangement and therefore the basic features here may easily be substituted for improved hardware or firmware arrangements as they are developed.

Storage device 730 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 725, read only memory (ROM) 720, and hybrids thereof.

The storage device 730 can include software modules 732, 734, 736 for controlling the processor 710. Other hardware or software modules are contemplated. The storage device 730 can be connected to the system bus 705. In one aspect, a hardware module that performs a particular function can include the software component stored in a computer-readable medium in connection with the necessary hardware components, such as the processor 710, bus 705, output device 742, and so forth, to carry out the function.

FIG. 7B illustrates an example computer system 750 having a chipset architecture that can be used in executing the described method and generating and displaying a graphical user interface (GUI). Computer system 750 can be computer hardware, software, and firmware that can be used to implement the disclosed technology. System 750 can include a processor 755, representative of any number of physically and/or logically distinct resources capable of executing software, firmware, and hardware configured to perform identified computations. Processor 755 can communicate with a chipset 760 that can control input to and output from processor 755. Chipset 760 can output information to output device 765, such as a display, and can read and write information to storage device 770, which can include magnetic media, and solid state media. Chipset 760 can also read data from and write data to RAM 775. A bridge 780 for interfacing with a variety of user interface components 785 can be provided for interfacing with chipset 760. Such user interface components 785 can include a keyboard, a microphone, touch detection and processing circuitry, a pointing device, such as a mouse, and so on. In general, inputs to system 750 can come from any of a variety of sources, machine generated and/or human generated.

Chipset 760 can also interface with one or more communication interfaces 790 that can have different physical interfaces. Such communication interfaces can include interfaces for wired and wireless local area networks, for broadband wireless networks, as well as personal area networks. Some applications of the methods for generating, displaying, and using the GUI disclosed herein can include receiving ordered datasets over the physical interface or be generated by the machine itself by processor 755 analyzing data stored in storage 770 or 775. Further, the machine can receive inputs from a user via user interface components 785 and execute appropriate functions, such as browsing functions by interpreting these inputs using processor 755.

It can be appreciated that systems 700 and 750 can have more than one processor 710 or be part of a group or cluster of computing devices networked together to provide greater processing capability.

Methods according to the aforementioned description can be implemented using computer-executable instructions that are stored or otherwise available from computer readable media. Such instructions can comprise instructions and data which cause or otherwise configure a general purpose computer, special purpose computer, or special purpose processing device to perform a certain function or group of functions. Portions of computer resources used can be accessible over a network. The computer executable instructions may be binaries, intermediate format instructions such as assembly language, firmware, or source code. Computer-readable media that may be used to store instructions, information used, and/or information created during methods according to the aforementioned description include magnetic or optical disks, flash memory, USB devices provided with non-volatile memory, networked storage devices, and so on.

For clarity of explanation, in some instances the present technology may be presented as including individual functional blocks including functional blocks comprising devices, device components, steps or routines in a method embodied in software, or combinations of hardware and software.

The computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Devices implementing methods according to these disclosures can comprise hardware, firmware and/or software, and can take any of a variety of form factors. Such form factors can include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device.

The instructions, media for conveying such instructions, computing resources for executing them, and other structures for supporting such computing resources are means for providing the functions described in these disclosures.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. Rather, the described features and steps are disclosed as possible components of systems and methods within the scope of the appended claims. Moreover, claim language reciting "at least one of" a set indicates that one member of the set or multiple members of the set satisfy the claim.

STATEMENTS OF THE DISCLOSURE INCLUDE

Statement 1: A method, comprising positioning a radiation detector at a first position within a wellbore, logging, via the radiation detector, radiation data while the radiation detector is moved from the first position to a second position adjacent to or past a radioactive marker disposed within the wellbore, determining, based on the radiation data, a time at which the radiation detector is adjacent to the radioactive marker as it is moved from the first to the second position, and calculating, based on the time, a distance between the first position of the radiation detector and the radioactive marker.

Statement 2: The method according to Statement 1, wherein calculating comprises determining a velocity of the radiation detector as it is moved within the wellbore, and multiplying the time by the velocity to calculate the distance between the first position of the radiation detector and the radioactive marker.

Statement 3: The method according to Statement 1 or 2, wherein the velocity is a predetermined constant velocity.

Statement 4: The method according to any of Statements 1-3, further comprising measuring, by an accelerometer, an acceleration of the radiation detector as it is moved within the wellbore, and modifying the velocity based on the acceleration of the radiation detector.

Statement 5: The method according to any of Statements 1-4, wherein the radiation detector is coupled with a wellbore tubular, and moving the radiation detector comprises raising or lowering the wellbore tubular within the wellbore.

Statement 6: The method according to any of Statements 1-5, further comprising positioning a downhole tool coupled with the wellbore tubular within the wellbore, and adjusting the position of the downhole tool based on the distance between the first position of the radiation detector and the radioactive tag.

Statement 7: The method according to any of Statements 1-6, wherein the radiation detector is a gamma ray detector and the radioactive marker is a radioactive pip tag.

Statement 8: The method according to any of Statements 1-7, wherein the radiation detector is coupled with a downhole telemetry unit that sends the radiation data to a surface telemetry unit in real-time.

Statement 9: A method, comprising positioning a first radiation detector and a second radiation detector at respective initial positions within a wellbore, wherein the first and second radiation detectors are separated by a fixed distance, logging radiation data while the radiation detectors are moved past a radioactive marker disposed within the wellbore, determining, based on the radiation data, a first time at which the first radiation detector is adjacent to the radioactive marker and a second time at which the second radiation detector is adjacent to the radioactive marker, calculating, based on the first and second times and the fixed distance, a velocity of the radiation detectors between the first time and the second time, and calculating, based on the first and second times and the velocity, a distance between the initial position of at least one of the first and second radiation detectors and the radioactive marker.

Statement 10: The method according to Statement 9, wherein the first and second radiation detectors are coupled with a wellbore tubular, and moving the radiation detectors comprises lowering or raising the wellbore tubular within the wellbore.

Statement 11: The method according to Statement 9 or 10, further comprising positioning a downhole tool coupled with the wellbore tubular within the wellbore, and adjusting the position of the downhole tool based on the distance between the initial position of at least one of the first and second radiation detectors detector and the radioactive tag.

Statement 12: The method according to any of Statements 9-11, wherein the radiation detectors are gamma ray detectors and the radioactive marker is a radioactive pip tag.

Statement 13: The method according to any of Statements 9-12, wherein the radiation detectors are coupled with a downhole telemetry unit that sends the radiation data to a surface telemetry unit in real-time.

Statement 14: The method according to any of Statements 9-13, further comprising measuring, by an accelerometer, an acceleration of the radiation detectors as they are moved between the first time and the second time, and modifying the velocity based on the acceleration of the radiation detectors.

Statement 15: A system, comprising a radioactive marker disposed within a wellbore, a first radiation detector for measuring radiation data within the wellbore, a wellbore tubular coupled with the radiation detector to position the radiation detector at an initial position within the wellbore and to move the radiation detector from the initial position to a position adjacent to or past the radioactive marker, a processor coupled with the radiation detector for receiving the radiation data, and a computer-readable storage medium having stored therein instructions which, when executed by the processor, cause the processor to perform operations comprising determining, based on the radiation data, a first time at which the radiation detector is adjacent to the radioactive marker, and calculating, based on the time, a distance between the initial position of the radiation detector and the radioactive marker.

Statement 16: The system according to Statement 15, wherein calculating comprises determining a velocity of the radiation detector as it is moved within the wellbore, and multiplying the time by the velocity to calculate the distance between the initial position of the radiation detector and the radioactive marker.

Statement 17: The system according to Statement 15 or 16, further comprising a downhole tool coupled with the wellbore tubular, wherein the wellbore tubular adjusts a position of the downhole tool based on the distance between the initial position of the radiation detector and the radioactive tag.

Statement 18: The system according to any of Statements 15-17, further comprising a surface telemetry unit located at a surface of the wellbore, the surface telemetry unit coupled with the processor and the computer-readable storage medium, and a downhole telemetry unit located at a downhole location within the wellbore, the downhole telemetry unit coupled with the radiation detector for sending the radiation data to the surface telemetry unit.

Statement 19: The system according to any of Statements 15-18, further comprising a second radiation detector coupled with the wellbore tubular, wherein the wellbore tubular positions the second radiation detector at an initial position a fixed distance from the first radiation detector and moves the second radiation detector past the radioactive tag, and wherein the computer-readable storage medium stores additional instructions which, when executed by the processor, cause the processor to perform operations comprising determining, based on the radiation data, a second time at which the second radiation detector is adjacent to the radioactive marker, calculating, based on the first and second times and the fixed distance, a velocity of the radiation detectors between the first time and the second time, and calculating, based on the first and second times and the velocity, a distance between the initial position of at least one of the first and second radiation detectors and the radioactive marker.

Statement 20: The system according to any of Statements 15-19, wherein the radiation detectors are gamma ray detectors and the radioactive marker is a radioactive pip tag.

I claim:

1. A method, comprising:

positioning a radiation detector at a first position within a wellbore;

logging, via the radiation detector, radiation data while the radiation detector is moved from the first position to a second position adjacent to or past a radioactive marker disposed within the wellbore;

determining, based on the radiation data, a time at which the radiation detector is adjacent to the radioactive marker as it is moved from the first to the second position; and calculating, based on the time, a distance between the first position of the radiation detector and the radioactive marker.

2. The method of claim 1, wherein calculating comprises:

determining a velocity of the radiation detector as it is moved within the wellbore; and multiplying the time by the velocity to calculate the distance between the first position of the radiation detector and the radioactive marker.

3. The method of claim 2, wherein the velocity is a predetermined constant velocity.

4. The method of claim 2, further comprising:

measuring, by an accelerometer, an acceleration of the radiation detector as it is moved within the wellbore; and modifying the velocity based on the acceleration of the radiation detector.

5. The method of claim 1, wherein the radiation detector is coupled with a wellbore tubular, and moving the radiation detector comprises raising or lowering the wellbore tubular within the wellbore.

6. The method of claim 5, further comprising:

positioning a downhole tool coupled with the wellbore tubular within the wellbore; and adjusting the position of the downhole tool based on the distance between the first position of the radiation detector and the radioactive tag.

7. The method of claim 1, wherein the radiation detector is a gamma ray detector and the radioactive marker is a radioactive pip tag.

8. The method of claim 1, wherein the radiation detector is coupled with a downhole telemetry unit that sends the radiation data to a surface telemetry unit in real-time.

9. A method, comprising:

positioning a first radiation detector and a second radiation detector at respective initial positions within a wellbore, wherein the first and second radiation detectors are separated by a fixed distance;

logging radiation data while the radiation detectors are moved past a radioactive marker disposed within the wellbore;

determining, based on the radiation data, a first time at which the first radiation detector is adjacent to the radioactive marker and a second time at which the second radiation detector is adjacent to the radioactive marker;

calculating, based on the first and second times and the fixed distance, a velocity of the radiation detectors between the first time and the second time; and calculating, based on the first and second times and the velocity, a distance between the initial position of at least one of the first and second radiation detectors and the radioactive marker.

10. The method of claim 9, wherein the first and second radiation detectors are coupled with a wellbore tubular, and moving the radiation detectors comprises lowering or raising the wellbore tubular within the wellbore.

11. The method of claim 10, further comprising:

positioning a downhole tool coupled with the wellbore tubular within the wellbore; and adjusting the position of the downhole tool based on the distance between the initial position of at least one of the first and second radiation detectors detector and the radioactive tag.

12. The method of claim 10, wherein the radiation detectors are gamma ray detectors and the radioactive marker is a radioactive pip tag.

13. The method of claim 10, wherein the radiation detectors are coupled with a downhole telemetry unit that sends the radiation data to a surface telemetry unit in real-time.

14. The method of claim 10, further comprising:

measuring, by an accelerometer, an acceleration of the radiation detectors as they are moved between the first time and the second time; and modifying the velocity based on the acceleration of the radiation detectors.

15. A system, comprising:

a radioactive marker disposed within a wellbore;

a first radiation detector for measuring radiation data within the wellbore;

a wellbore tubular coupled with the radiation detector to position the radiation detector at an initial position within the wellbore and to move the radiation detector from the initial position to a position adjacent to or past the radioactive marker;

a processor coupled with the radiation detector for receiving the radiation data; and a computer-readable storage medium having stored therein instructions which, when executed by the processor, cause the processor to perform operations comprising:

determining, based on the radiation data, a first time at which the radiation detector is adjacent to the radioactive marker; and calculating, based on the time, a distance between the initial position of the radiation detector and the radioactive marker.

16. The system of claim 15, wherein calculating comprises:

determining a velocity of the radiation detector as it is moved within the wellbore; and multiplying the time by the velocity to calculate the distance between the initial position of the radiation detector and the radioactive marker.

17. The system of claim 15, further comprising:

a downhole tool coupled with the wellbore tubular, wherein the wellbore tubular adjusts a position of the downhole tool based on the distance between the initial position of the radiation detector and the radioactive tag.

18. The system of claim 15, further comprising:

a surface telemetry unit located at a surface of the wellbore, the surface telemetry unit coupled with the processor and the computer-readable storage medium; and a downhole telemetry unit located at a downhole location within the wellbore, the downhole telemetry unit coupled with the radiation detector for sending the radiation data to the surface telemetry unit.

19. The system of claim 15, further comprising:

a second radiation detector coupled with the wellbore tubular, wherein the wellbore tubular positions the second radiation detector at an initial position a fixed distance from the first radiation detector and moves the second radiation detector past the radioactive tag; and wherein the computer-readable storage medium stores additional instructions which, when executed by the processor, cause the processor to perform operations comprising:

determining, based on the radiation data, a second time at which the second radiation detector is adjacent to the radioactive marker;

calculating, based on the first and second times and the fixed distance, a velocity of the radiation detectors between the first time and the second time; and calculating, based on the first and second times and the velocity, a distance between the initial position of at least one of the first and second radiation detectors and the radioactive marker.

20. The system of claim 19, wherein the radiation detectors are gamma ray detectors and the radioactive marker is a radioactive pip tag.

* * * * *